US010315420B2

(12) United States Patent
Pelletier

(10) Patent No.: US 10,315,420 B2
(45) Date of Patent: Jun. 11, 2019

(54) PRINTING APPARATUS AND METHOD FOR PRINTING

(71) Applicant: SUBLINOVE INC., Montréal (CA)

(72) Inventor: Andrée Pelletier, Montréal (CA)

(73) Assignee: SUBLINOVE INC., Montréal (CA)

( * ) Notice: Subject to any disclaimer, the term of this patent is extended or adjusted under 35 U.S.C. 154(b) by 161 days.

(21) Appl. No.: 15/536,963

(22) PCT Filed: Dec. 15, 2015

(86) PCT No.: PCT/CA2015/051325

§ 371 (c)(1),
(2) Date: Jun. 16, 2017

(87) PCT Pub. No.: WO2016/095034

PCT Pub. Date: Jun. 23, 2016

(65) Prior Publication Data

US 2018/0050539 A1 Feb. 22, 2018

Related U.S. Application Data

(60) Provisional application No. 62/092,593, filed on Dec. 16, 2014.

(51) Int. Cl.

| | |
|---|---|
| ***B41J 2/14*** | (2006.01) |
| ***B41J 2/04*** | (2006.01) |
| ***B41J 2/175*** | (2006.01) |
| ***B41J 29/38*** | (2006.01) |
| ***B41M 5/035*** | (2006.01) |

(52) U.S. Cl.

CPC ..... *B41J 2/14137* (2013.01); *B41J 2/04* (2013.01); *B41J 2/14* (2013.01); *B41J 2/175* (2013.01); *B41J 2/17553* (2013.01); *B41J 29/38* (2013.01); *B41M 5/035* (2013.01); *B41J 2002/14185* (2013.01)

(58) Field of Classification Search

CPC .... B41J 2/14137; B41J 29/38; B41J 2/17553; B41J 2/175; B41J 2/04; B41J 2/14; B41J 2002/14185; B41M 5/035

See application file for complete search history.

(56) References Cited

U.S. PATENT DOCUMENTS 4,901,095 A * 2/1990 Perra, Jr. ..... B41J 2/01 346/145

FOREIGN PATENT DOCUMENTS

WO 2007025368 3/2007

OTHER PUBLICATIONS

IP.com search (Year: 2018).*

English Abstract of CN104690966(A), "Supersonic nozzle for miniature ink jet printing", published on Jun. 10, 2015.

English Abstract of JPH0351134(A), "Ink Jet Recoridng Head", published on Mar. 5, 1991.

* cited by examiner

*Primary Examiner* — Lisa Solomon

(74) *Attorney, Agent, or Firm* — Bereskin & Parr LLP/S.E.N.C.R.L., s.r.l.

(57) ABSTRACT

A printing apparatus includes an ink treatment chamber having an inlet for receiving ink into the chamber. The ink is received in a non-gaseous statement. Heating elements heat the ink in the ink treatment chamber. After being heated, a nozzle ejects the heated ink. The heating of the ink may cause the ink to be changed to a gaseous ink and the gaseous ink may be ejected by the nozzle.

12 Claims, 12 Drawing Sheets

PRINTING APPARATUS AND METHOD FOR PRINTING

CROSS-REFERENCE TO RELATED APPLICATIONS

The present application is a 35 USC 371 national stage entry of PCT/CA2015/051325 filed on Dec. 15, 2015 and which claims priority on U.S. 62/092,593 filed on Dec. 16, 2014. These documents are hereby incorporated by reference in their entirety.

FIELD OF THE DISCLOSURE

The present disclosure relates to a printing apparatus and method for printing, and more particularly a method and system in which the ink is heated and undergoes a phase change.

BACKGROUND OF THE DISCLOSURE

U.S. Pat. No. 7,325,910 to Pelletier discloses a sublimation pen or cartridge for use in a dye sublimation printing system, which is to be used with sublimation inks of the type including at least a liquid carrier and solid-form pigments insoluble in the liquid carrier. The sublimation pen includes a pen main body, an ink inlet provided on the pen main body, and a variable-width ink passageway defined within the pen main body and capable of fluidly communicating with the ink inlet. The ink passageway defines a sublimation chamber vestibule adjacent to the ink inlet and capable of fluidly communicating therewith, and a sublimation chamber in fluid communication with the sublimation chamber vestibule, the sublimation chamber being wider than the sublimation chamber vestibule. The sublimation pen further includes a heating device means capable of transmitting heat to the sublimation chamber; and a nozzle mounted to the pen main body, the nozzle defining a narrow discharge channel opening at a first end into the sublimation chamber outlet, and opening at a second end outwardly of the sublimation pen. Sublimation ink injected in the pen body through the pen sublimation ink inlet may flow in the ink passageway, first through the sublimation chamber vestibule and then into the wider sublimation chamber within which the solid-state pigments of the sublimation ink are sublimed, the sublimed pigments being thereafter forcibly discharged out of the pen through the discharge channel of the nozzle.

SUMMARY

It would thus be highly desirable to be provided with a device, system or method that would at least partially address the disadvantages of the existing technologies.

The embodiments described herein provide in one aspect a printing apparatus comprising a housing defining an ink treatment chamber, an inlet for receiving into the ink treatment chamber ink in a non-gaseous state, heating elements for heating the ink received in the ink treatment chamber, and a nozzle for ejecting the heated ink.

The embodiments described herein provide in another aspect a method for printing, the method comprising providing ink in a non-gaseous state, heating the ink, and applying the ink to a material after heating.

The embodiments described herein provide in another aspect a printing system comprising a first printing apparatus according to various exemplary embodiments described herein, the ink of the first printing apparatus having a first color, and a second printing apparatus according to various exemplary embodiments described herein, the ink of the second printing apparatus having a second color.

DRAWINGS

The following drawings represent non-limitative examples in which.

DESCRIPTION OF VARIOUS EMBODIMENTS

Figure 1:
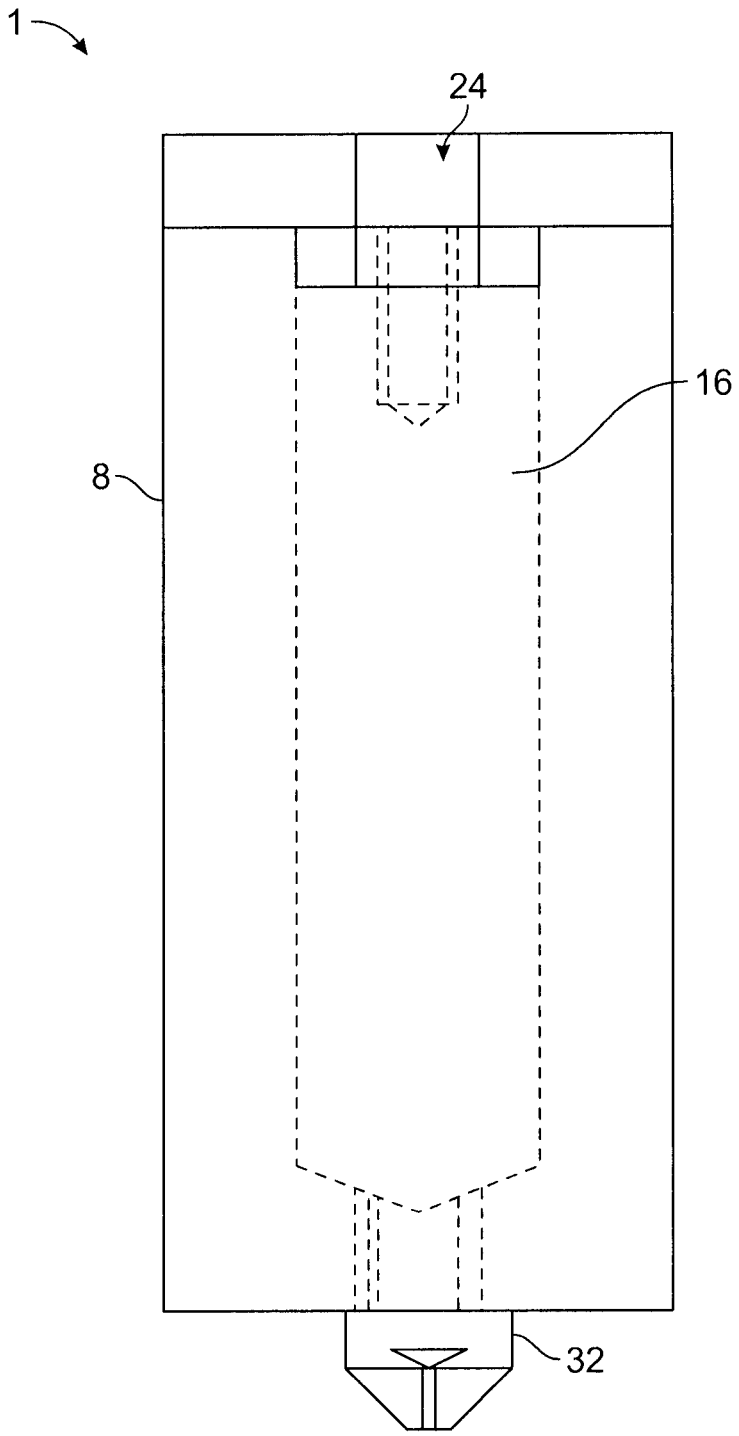
FIG. 1 illustrates an elevated cross-sectional view of a printing apparatus according to one exemplary embodiment.

The following examples are presented in a non-limiting manner.

The word "a" or "an" when used in conjunction with the term "comprising" in the claims and/or the specification may mean "one", but it is also consistent with the meaning of "one or more", "at least one", and "one or more than one" unless the content clearly dictates otherwise. Similarly, the word "another" may mean at least a second or more unless the content clearly dictates otherwise.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements or process steps.

The terms "coupled" or "coupling" as used herein can have several different meanings depending in the context in which these terms are used. For example, the terms coupled or coupling can have a mechanical or electrical connotation. For example, as used herein, the terms coupled or coupling can indicate that two elements or devices are directly connected to one another or connected to one another through one or more intermediate elements or devices via an electrical element, electrical signal or a mechanical element depending on the particular context.

According to example apparatuses disclosed herein, heating the ink causes the ink to be changed to gas in the ink treatment chamber and wherein the nozzle ejects the ink in the gaseous state.

According to example apparatuses disclosed herein, the ink in the non-gaseous state is received in a solid state and wherein heating the ink causes sublimation of the ink.

According to example apparatuses disclosed herein, the ink treatment chamber is pressurized at a range of pressures permitting sublimation of the ink.

According to example apparatuses disclosed herein, the ink in the non-gaseous state is received in a liquid state and wherein heating the ink causes evaporation of the ink.

According to an example, wherein the ink can comprise at least one component in a solid state and/or at least one component in a liquid state.

According to example apparatuses disclosed herein, the nozzle is adapted for accelerating the ink when ejecting the ink.

According to example apparatuses disclosed herein, the nozzle comprises a Laval nozzle According to example apparatuses disclosed herein, the heating elements are positioned outside the ink treatment chamber.

According to example apparatuses disclosed herein, the housing comprises: a block member, a first bore machined in the block member defining the ink treatment chamber, and at least a second bore machined in the block member for receiving the heating element.

According to example systems disclosed herein, the block member of the first printing apparatus and the block member of the second printing apparatus are received in a thermally insulated support member.

According to example methods disclosed herein, heating the ink causes the ink to be changed to gas and wherein applying the ink comprises applying the ink in the gaseous state.

According to example methods disclosed herein, the ink in the non-gaseous state is provided in a solid state and heating the ink causes sublimation of the ink.

According to example methods disclosed herein, the ink in the non-gaseous state is provided in an ink treatment chamber, the ink is heated in the ink treatment chamber, and the ink treatment chamber is pressurized to a range of pressures permitting sublimation of the ink.

According to example methods disclosed herein, the ink in the non-gaseous state is provided in a liquid state and heating the ink causes evaporation of the ink.

According to example methods disclosed herein, the method further comprises accelerating the ink prior to applying the ink to the material.

Referring now to FIG. 1, therein illustrated is an elevated cross-sectional view of a printing apparatus 1 according to various exemplary embodiments. The printing apparatus 1 includes a housing 8 defining an ink treatment chamber 16.

The printing apparatus 1 further includes an inlet 24 for receiving ink into the ink treatment chamber 16. The ink may be received from a source of ink, such as an ink cartridge. The providing of ink into the ink treatment chamber 16 via the inlet 24 may be controlled using an ink dispensing device, which may be a device known in the art.

Figure 2:
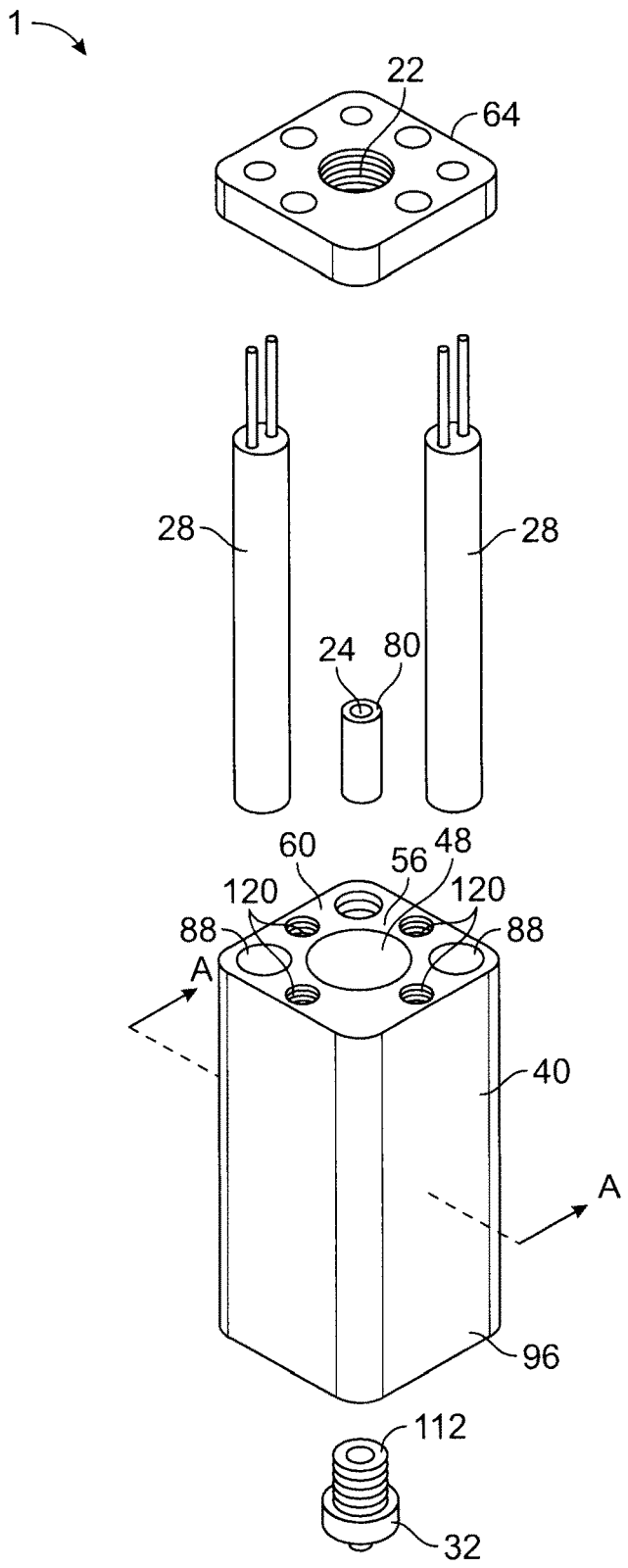
FIG. 2 illustrates an exploded view of a printing apparatus according to one exemplary embodiment.

The printing apparatus further includes at least one heating element 28 (FIG. 2). The at least one heating element emits heat into the ink treatment chamber 16, thereby heating the ink received therein. The heating element 28 may be any element known in the art that emits heat, such as a heating coil or resistive heating element.

The printing apparatus 1 further includes a nozzle 32 in fluid communication with the ink treatment chamber 16. Ink received in the ink treatment chamber 16 is treated according to various exemplary embodiments described herein. After being treated, the treated ink is ejected from the nozzle 32. In use, the nozzle 32 is positioned proximate a material to be printed such that the ejected ink contacts the material, thereby causing printing of the material.

Referring now to FIG. 2, therein illustrated is an exploded view of a printing apparatus 1 according to various exemplary embodiments. As illustrated, the housing 8 may include a block member 40 defining a recess 48 having a first opening 56. The recess 48 may be formed by machining a bore from a top surface 60 of the block member 40. The bore may extend through the length 64 of the block member 40. Alternatively, the bore may extend through a portion of the length 64 of the block member 40. The recess 48 defines a portion of the ink treatment chamber 16.

The recess 48 may be covered by a cap member 64. The cap member 64 has a throughhole 72, which may be internally threaded. The cap member 64 may be disposed against the top surface 60 of the block member 40 to partially cover the first opening 56 of the recess 48. It will be appreciated that the ink treatment chamber 16 communicates with an exterior of the housing 8 through the throughhole 72 of the cap member 64.

The printing apparatus 1 may further include an inlet member 80 defining the inlet 24 of the printing apparatus 1. The inlet member 80 is adapted to be fluidly coupled to an ink line, which may be further connected to a source of ink. The inlet member 80 may be externally threaded and appropriate sized to engage the internally threaded the throughole 72 of the cap member 64.

The block member 40 may have further formed therein second recesses 88 for receiving the heating elements 28. The second recesses 88 may be located peripherally of the first recess 48. The second recesses 88 may be elongated to receive elongated heating elements 28. The second recesses may extend through a substantial portion of length of 64 the block member 40 and the elongated heating element 28 extends through an approximately equivalent portion of the length 64 of the block member 40. For example, the second recesses and the elongated heating element 28 may extend through at least about 80% of the length of the block member 40. The second recesses 88 may be formed by machining bores from a top surface 60 of the block member 40. It will be appreciated that by having the heating element 28 located peripherally of the ink treatment chamber 16 and extending over a substantial portion of the length 64 of the ink treatment chamber 16, heat emitted by the heating elements 28 may be transmitted substantially evenly into the ink treatment chamber 16. As illustrated, the heating elements 28 may be positioned outside the ink treatment chamber 16.

An end 96 of the body member 40 opposite the top surface 64 may define a second opening 104 for receiving the nozzle 32. For example, the second opening 104 may be formed by machining a bore through the body member 40. For example, the bore may be the same as the bore for forming recess 48. Alternatively, an additional bore having a diameter lesser than the bore for forming recess 48 may be machined to form the second opening 104. According to various exemplary embodiments, the second opening 104 may be internally threaded to engage an externally threaded portion 112 of the nozzle 32.

The body member 40 may further include third internally threaded bores 120 for receiving fasteners as described elsewhere herein.

Figure 3:
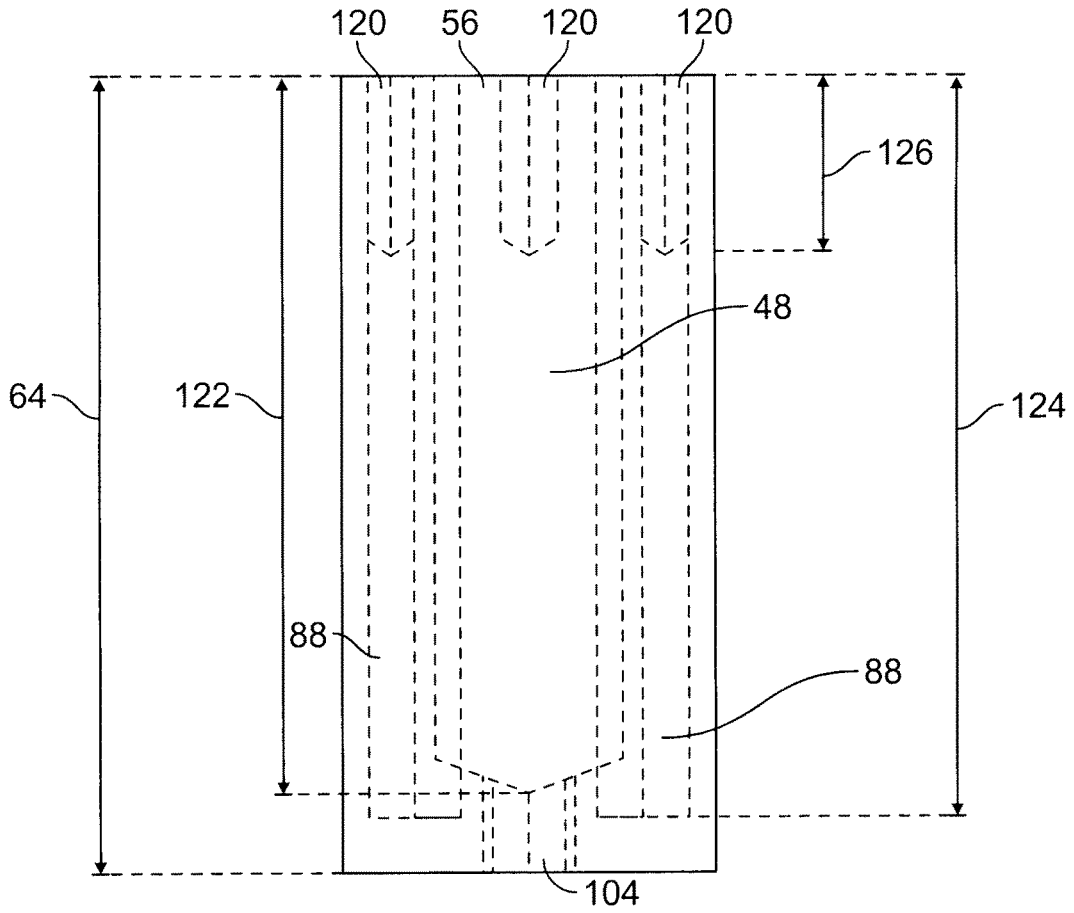
FIG. 3 illustrates a sectional view along the line A-A of a body member of the exemplary printing apparatus.

Referring now to FIG. 3, therein illustrated is a sectional view along the line A-A of the body member 40 of the housing 8 according to various exemplary embodiments. It will be appreciated that the first recess 48 extends along a first recess length 122, which is less than the length 64 of the body member 40. The first recess 48 is further in fluid communication with second opening 104. It will also be appreciated that the second recesses 88 extends along a second recess length 124, which is less than the length 64 of the body member 40. The third threaded bores 120 extend along a third bore length 126, which may be shorter than half the length 64 of the bore member 40.

Figure 4:
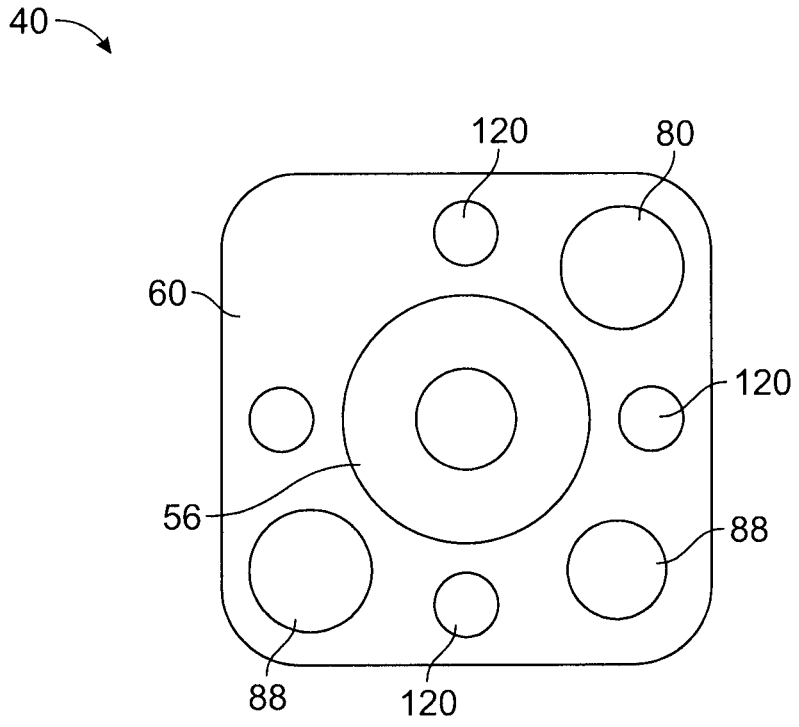
FIG. 4 illustrates a top view of the top surface of the body member of the exemplary printing apparatus.

Referring now to FIG. 4, therein illustrated is a top view of the top surface of the body member 40 showing the positioning of the first recess 48, second recesses 88 and third threaded bores 120.

The body member 40 may be formed of a thermally conductive material so that heat emitted from the heating elements 28 are transferred to inside the ink treatment chamber 16.

According to various exemplary embodiments, ink that is initially in a non-gaseous state is received in the ink treatment chamber 16. Accordingly, the heating elements 28 are selected so that the heat emitted into the ink treatment chamber 16 is sufficient to cause a phase change in the ink received in the ink treatment chamber 16. For example, the initially non-gaseous ink is changed to a gaseous ink due to heating.

According to various exemplary embodiments, the ink is initially received in a liquid state into the ink treatment chamber 16 through the inlet 24. Due to heating from heating elements 28, the liquid ink is transformed to gaseous ink through evaporation. The gaseous ink may then be emitted from the nozzle 32 for printing a material.

According to various exemplary embodiments, the ink is initially received in a solid state into the ink treatment chamber 16 through the inlet 24. For example, the solid ink may be carried in a liquid carrier, such as alcohol. Due to heating from heating elements 28, the solid ink is transformed to gaseous ink through sublimation. The gaseous ink may then be emitted from the nozzle 32 for printing a material. Accordingly, the ink treatment chamber 16 may be pressurized at a pressure that corresponds to about the triple point of the material forming the ink. For example, the ink treatment chamber 16 may be appropriately sized to achieve and maintaining the pressure corresponding to about the triple point of the material forming the ink.

Ejecting the ink in a gaseous state for printing may advantageously permit embedding the ink within a material to be printed. For example, whereas liquid ink may only print an exterior surface of the material to be printed, gaseous ink can permeate into the material, thereby resulting in embedding of the gaseous ink with the material. When printing the material, the gaseous ink may return to a liquid and/or solid state.

Figure 5:
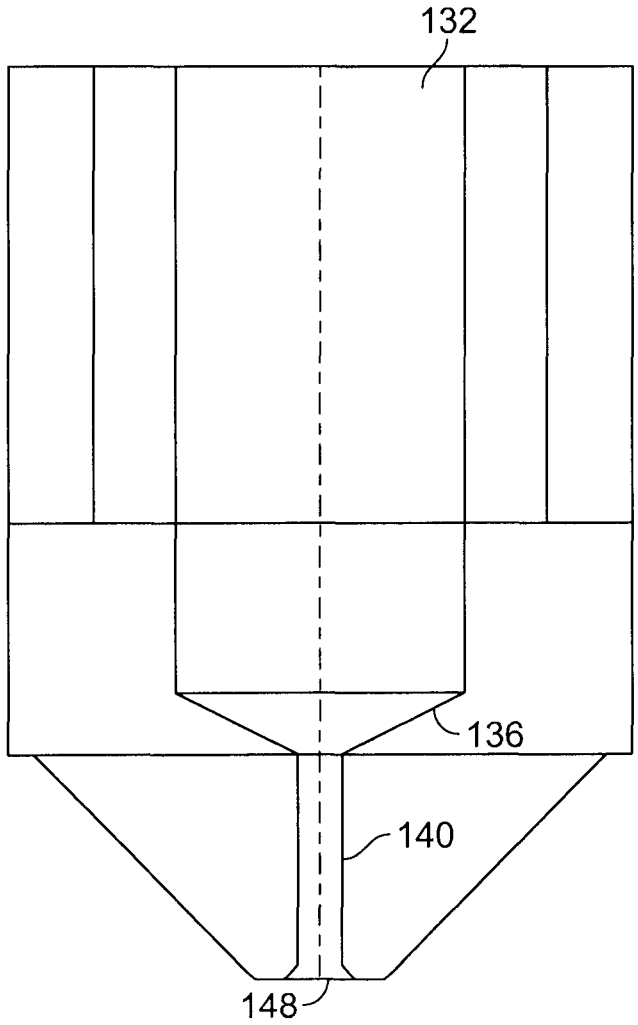
FIG. 5 illustrates an elevated cross-sectional view of a nozzle of the printing apparatus according to the exemplary embodiment.

Referring now to FIG. 5, therein illustrated is an elevated cross-sectional view of a nozzle 32 according to one exemplary embodiment. The nozzle 32 defines an upper channel 132 in fluid communication with the ink treatment chamber 16 or partly defining the ink treatment chamber 16. The upper channel 132 leads through a transitional channel 136 having a decreasing diameter. The transitional channel 136 further leads to a lower channel 140 having a diameter that is substantially less than a diameter of the upper channel 132. A spout 148 of the nozzle 32 has an increasing diameter. It will be appreciated that the narrowing of the channel flowed by an increasing diameter at the spout 148 creates a Venturi effect whereby the flow of ink when being ejected through the nozzle 32 is accelerated. For example, the lower channel 140 of the nozzle 32 defines a Laval nozzle.

Figure 6:
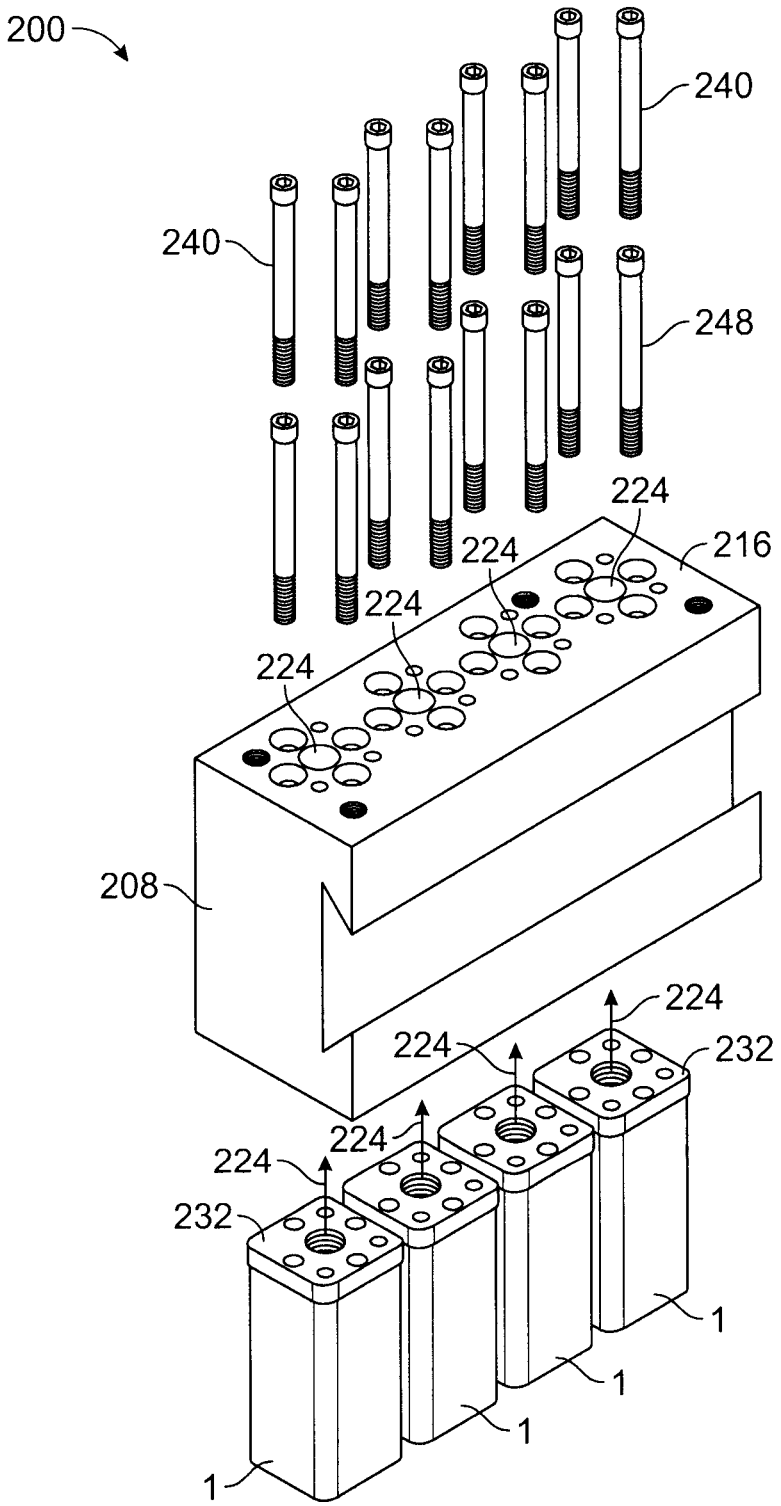
FIG. 6 illustrates an exploded view of a printing system according to one exemplary embodiment.

Referring now to FIG. 6, therein illustrated is an exploded view of a printing system 200 according to various exemplary embodiments. The printing system 200 includes a plurality of printing apparatuses 1 according to various exemplary embodiments described herein. The printing apparatuses 1 are shown having been assembled, wherein the cap member 64 is coupled to the body member 40 and the heating elements 28 are inserted into recesses 88 of the body member 40. At least two of the printing apparatuses 1 may be adapted for ejecting ink of different color, material or texture. For example, a first of the printing apparatuses 1 is adapted to eject ink of a first color, material or texture and a second of the printing apparatuses 1 is adapted to eject ink of a second color, material or texture that is different from the first color, material of texture.

The printing system 200 further includes a support member 208 for supporting the plurality of printing apparatuses 1. The support member 208 has a top surface 216 defining a plurality of throughholes.

Figure 7:
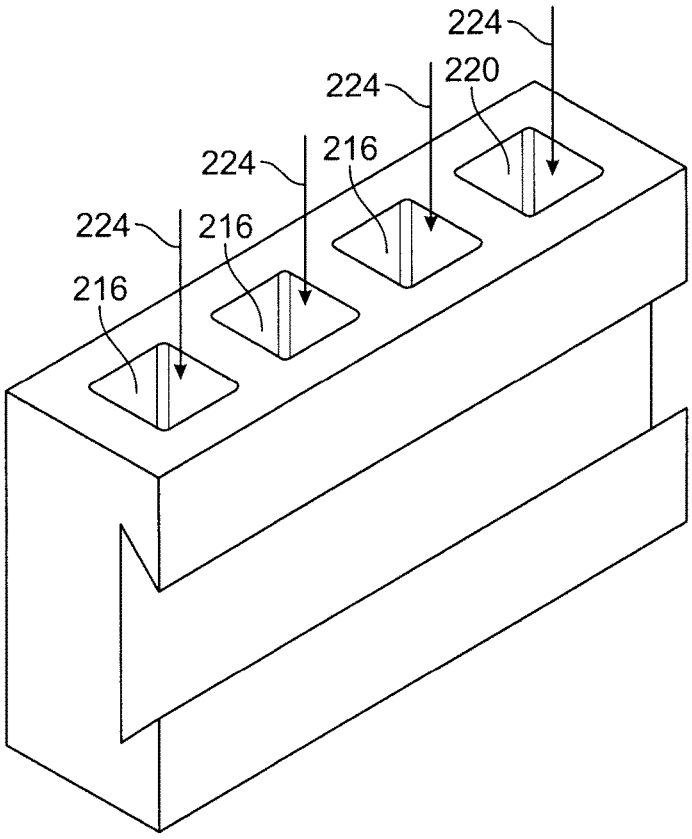
FIG. 7 illustrates a bottom perspective view of a support member of the printing system according to the exemplary embodiment.

Referring now to FIG. 7, therein illustrated is a bottom perspective view of the support member 208 according to various exemplary embodiments. The support member 208 includes a plurality of slots 220 each being sized to receive one printing apparatus 1.

Continuing with FIGS. 6 and 7 together, the printing apparatuses 1 are each inserted into a respective slot 220 of the support member 208. The printing apparatuses 1 are oriented in the direction shown and as denoted by arrows 224. In particular, the top surface 232 of the cap member 64 of the printing apparatuses are oriented in the direction of the arrows 224.

According to various exemplary embodiments, the support member 200 is formed of a thermally insulating material, such as polytetrafluoroethylene. The thermally insulating support member ensures that heat emitted from the heating elements 28 are kept within the slots 220 and in particular emitted to the ink treatment chamber 16.

Figure 8:
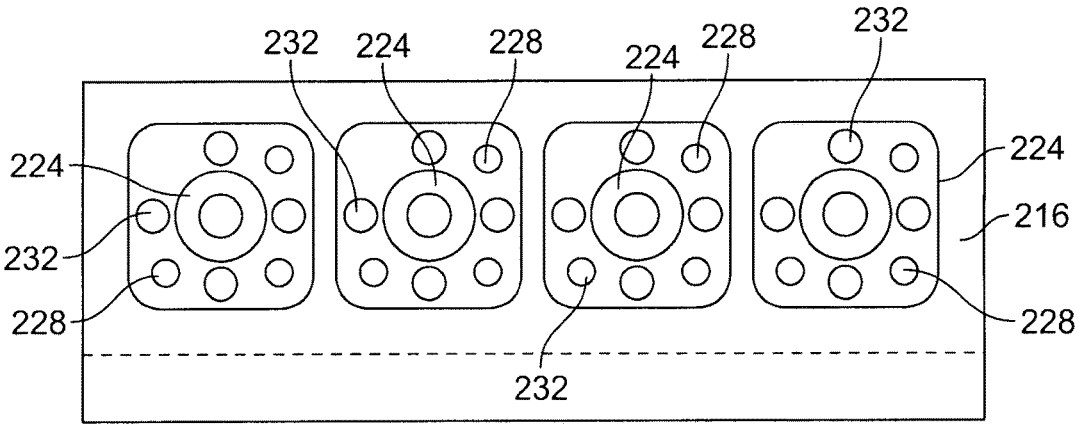
FIG. 8 illustrates a plan view of the support member of the printing system according to the exemplary embodiment.

FIG. 8 illustrates a plan view of the support member 200. It will be appreciated that the throughholes correspond to recesses of the printing apparatuses 1.

Referring now to FIGS. 6 and 8, the plurality of throughholes of the support member 208 extend through the top surface 216 to communicate with the slot 220 of the support member 208.

For example, the throughholes include first holes 224 corresponding to inlets 24 of printing apparatuses 1. An ink line connecting an inlet 24 of a printing apparatuses 1 to a source of ink may extend through one of the first holes 224.

For example, the throughholes include second holes 228 corresponding to second recesses 88 of the printing apparatuses 1. Leads or wires connecting the heating elements 28 to a power source may extend through the second holes 228.

For example, the throughholes include third holes 232 corresponding to third recesses 120 of the printing apparatuses 1. Fasteners 240 may extend through the third holes 232 to engage the third recesses 120 of the printing apparatuses 1, thereby maintaining the printing apparatuses 1 in their respective slots 220 of the support member 200.

According to various exemplary embodiments, the fasteners 240 may be spring members that allow some movement of the printing apparatuses 1 within the slots 220 and in both directions denoted by arrows 224. For example, movement of the printing apparatuses 1 allows some play in the printing apparatuses 1 in response to uneven printing materials.

Figure 9:
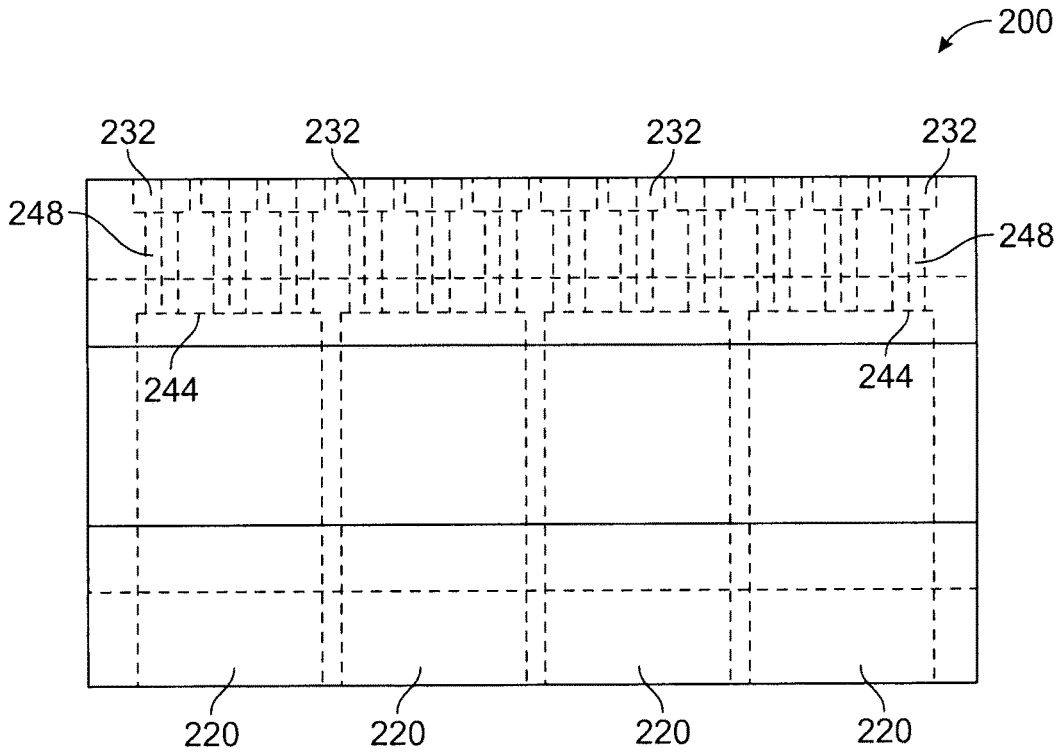
FIG. 9 illustrates a front cross-sectional view of the support member of the printing system according to the exemplary embodiment.
Figure 10:
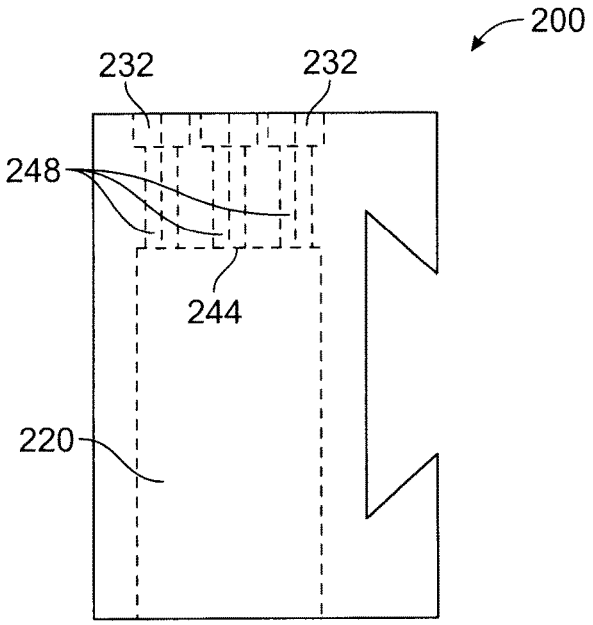
FIG. 10 illustrates a side cross-sectional view of the support member of the printing system according to the exemplary embodiment.

Referring now to FIGS. 9 and 10, therein illustrated are a front cross-sectional view and side sectional view of the support member 200 according to various exemplary embodiments. It will be appreciated that the third holes 232 are spaced apart from the bottoms 244 of the slots 220 by elongated channels 248. The spring members of the fasteners 240 are positioned within the elongated channels 248, thereby allowing extension and contraction of the spring members, further leading to movement of the printing apparatuses 1 within the slots 220.

Figure 11:
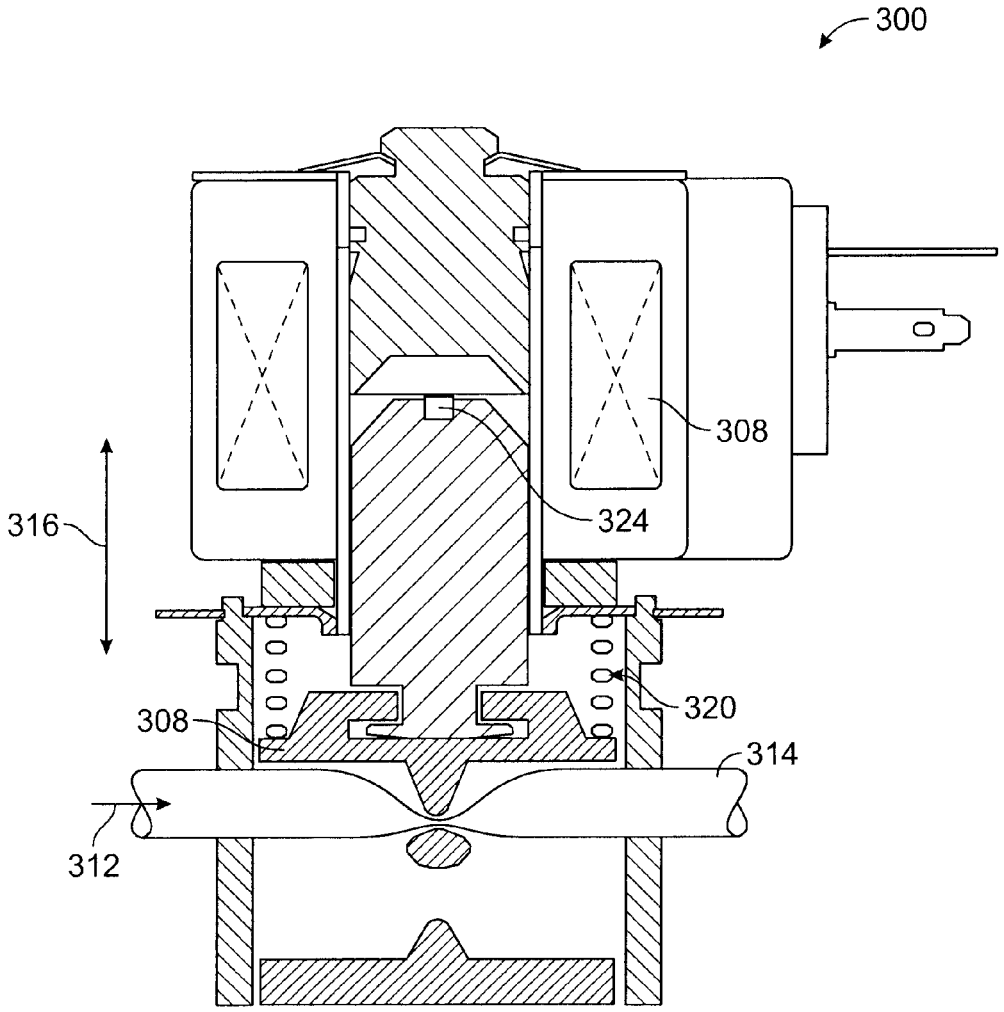
FIG. 11 illustrates a cross-sectional view of an ink dispensing device 300 according to one exemplary embodiment.

Referring now to FIG. 11, therein illustrated is a cross-sectional view of an exemplary ink dispensing device 300. The ink dispensing device 300 is positioned upstream of the inlet 24 of a printing apparatus and controls the flow of ink from the ink source to the ink treatment chamber 16 of the printing apparatus 1. The ink dispensing device 300 includes a plunger member 308 for selectively pinching an ink line 310. As illustrated, a first end 312 of the ink line 310 leads from an ink source and a second end 314 of the ink line 310 leads to the printing apparatus 1.

The plunger member 308 may be movable along the direction 316 and may be biased to a pinching position by spring members 320. In the pinching position, the plunger member 308 pinches the ink line 310 to prevent flow of ink from the first end 312 to the second 314.

The plunger member 308 is moved away from its pinching position so as to permit flow of ink from the first end 312 to the second end. For example, the plunger member 308 may be coupled to a magnet 324 which surrounded by coiled windings 328. Sending a current through the coiled windings 328 induces an electromagnetic field, which causes the magnet 324, and therefore also the plunger member 308, to be moved away from the pinching position.

According to various exemplary methods described herein, ink for printing a material is provided in a non-gaseous state. Heating is applied to the ink. After heating the ink, the ink is applied to a material so as to print on that material.

For example, the ink is heated so that it is changed to a gaseous state and the gaseous ink is applied to the material.

For example, the ink is provided in a solid state and heating the ink causes sublimation of the ink. The solid ink may be provided in a liquid carrier. The solid ink may be undissolved within the liquid carrier and is transported with the flow of the liquid carrier. The solid ink may be heated in a pressure-controlled environment, such as an ink treatment chamber, wherein the pressure is controlled to correspond to the triple point of the material forming the ink.

For example, the ink is provided in a liquid state and heating the ink causes sublimation of the ink.

For example, prior to applying the ink to the material, the flow of the ink in the gaseous state may be accelerated, such as through a Laval nozzle.

For example, various methods described herein may be carried out using one or more printing apparatuses 1 described herein.

For example, the disclosure also comprises a printing system comprising at least one printing apparatus as defined in the present disclosure and at least one control system as defined in the present disclosure.

For example, there is provided the use of a printing apparatus as described in the present disclosure, for use in a printing system.

Figure 13:
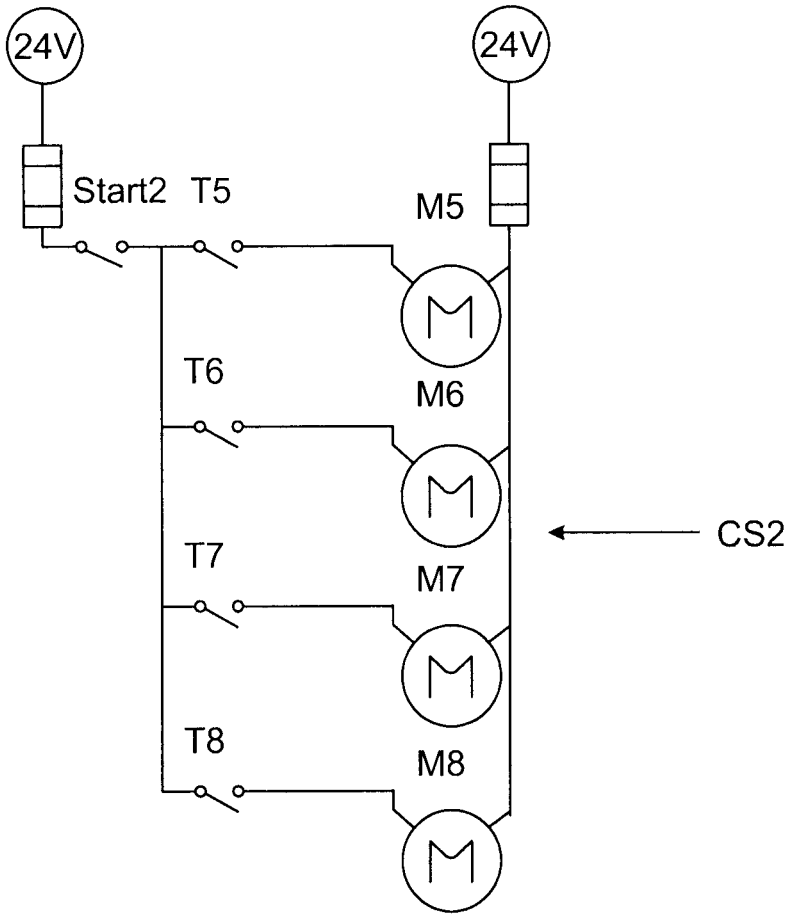
FIG. 13 illustrates a schematic representation of a control system according to another exemplary embodiment.
Figure 14:
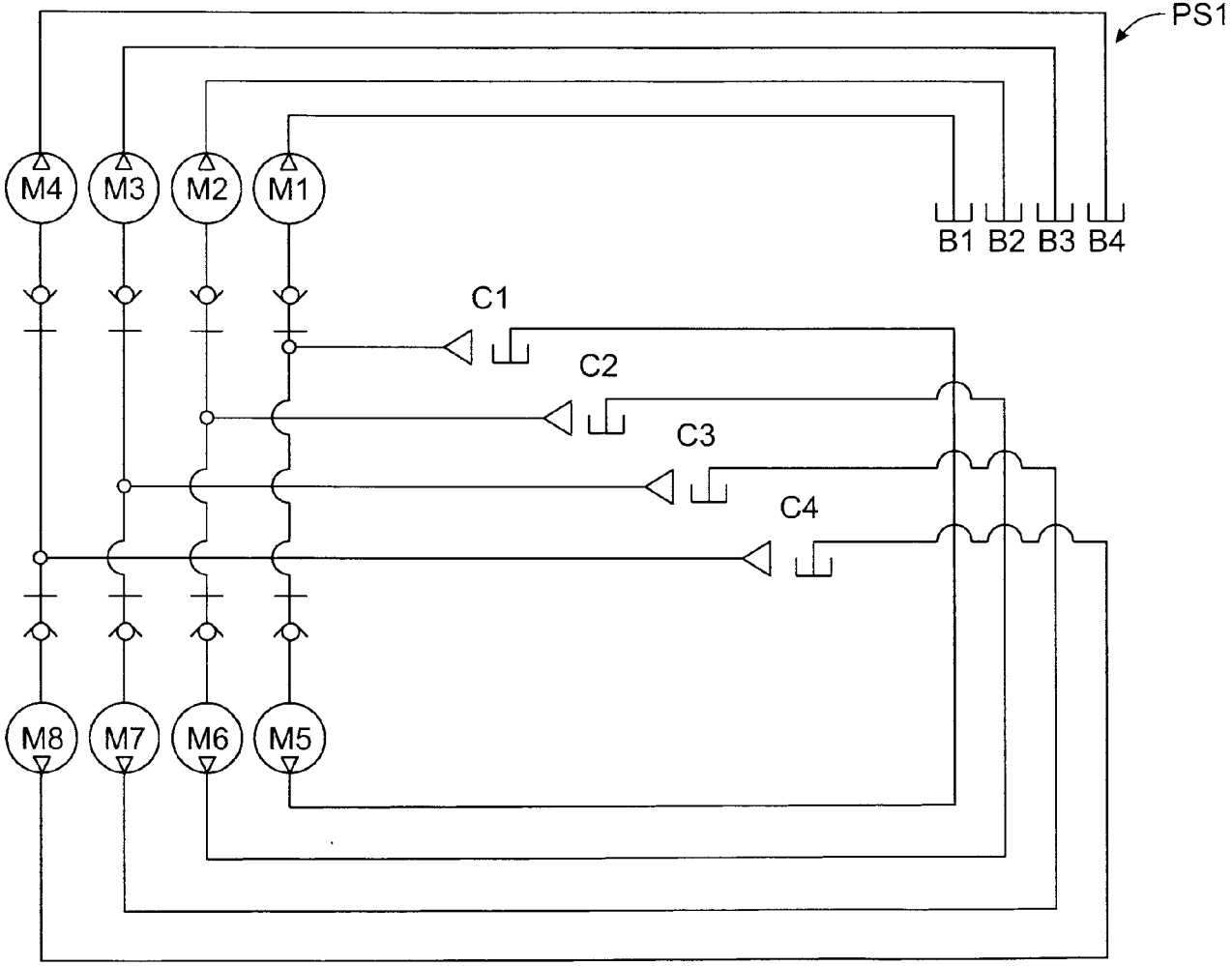
FIG. 14 illustrates a schematic representation of a printing system according to one exemplary embodiment.

For example, the printing apparatuses described in the present disclosure can be used in a printing system (PS1) as the one schematically represented in FIG. 14. The system of FIG. 14 can comprise control systems. For example, it can comprise one control system as shown in FIG. 12 (CS1) (see M1, M2, M3 and M4) and one control system as shown in FIG. 13 (CS2) (see M5, M6, M7 and M8).

Figure 12:
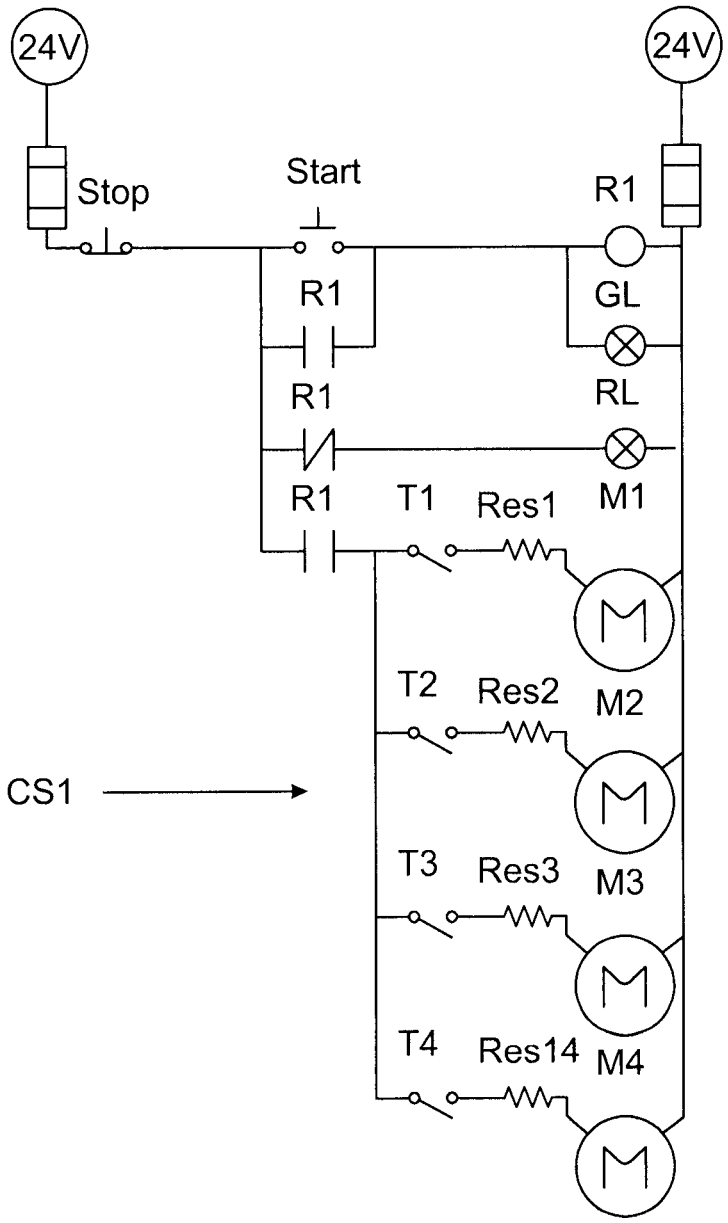
FIG. 12 illustrates a schematic representation of a control system according to one exemplary embodiment.

In FIGS. 12-14, M1, M2, M3, M4, M5, M6, M7 and M8 refer to different motors, the term M referring to a motor in general; in FIG. 14, C1, C2, C3 and C4 refer to different cartridges, while B1, B2, B3 and B4 refer to different print heads or printing apparatuses. In FIGS. 12 and 13, T1, T2, T3, T4, T5, T6, T7 and T8 refer to different fix buttons, while Start refer to a start button and Stop refer to a stop button In FIG. 12, R1 refers to a relay and Res1, Res2, Res3 and Res 4 refer to variable resistors, while GL and RL refer respectively to green light and red light.

Regarding CS1 of FIG. 12, when system is OFF, the red light (RL) will be on, no motor will be running. Pushing the start button will power relay 1 (R2), closing R1 contact and creating a latch, it will also turn the green light on, turn red light off. While R1 is closed, closing T1 will activate M1, closing T2 will activate M2, closing T3 activates M3, and T4 activates M4. All motors speeds are variable and controlled by one variable switch. Pushing the STOP push button, will de-energize R1 relay. It will open the close R1 contacts which will power off all motors. It will also close the open R1 contact and will power the RED light.

Regarding CS2 of FIG. 13, while Start 2 button is closed, closing T5 will activate M5, closing T6 will activate M6, closing switch T7 will activate M7 and closing switch T8 will activate M8. Opening the Start 2 switch will stop all motors.

The examples provided in FIGS. 12-14 clearly show how the printing apparatuses and methods of the disclosure can be used in a printing system. The person skilled in the art would clearly know how to integrate and/or incorporate the various possibilities described in the present disclosure into different printing systems.

It will be appreciated that, for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way but rather as merely describing the implementation of the various embodiments described herein.

The invention claimed is:

1. A printing apparatus comprising:

a housing defining an ink treatment chamber;

an inlet for receiving into the ink treatment chamber ink in a non-gaseous state;

heating elements for heating the ink received in the ink treatment chamber; and a nozzle for ejecting the heated ink, wherein the housing comprises:

a block member;

a first bore machined in the block member defining the ink treatment chamber; and at least a second bore machined in the block member for receiving the heating element.

2. The printing apparatus of claim 1, wherein heating the ink causes the ink to be changed to gas in the ink treatment chamber and wherein the nozzle ejects the ink in the gaseous state.

3. The printing apparatus of claim 2, wherein the ink in the non-gaseous state is received in a solid state and wherein heating the ink causes sublimation of the ink.

4. The printing apparatus of claim 3, wherein the ink in the solid state is undissolved in a liquid carrier.

5. The printing apparatus of claim 2, wherein the ink treatment chamber is pressurized at a range of pressures permitting sublimation of the ink.

6. The printing apparatus of claim 2, wherein the ink in the non-gaseous state is received in a liquid state and wherein heating the ink causes evaporation of the ink.

7. The printing apparatus of claim 2, wherein the nozzle is adapted for accelerating the ink when ejecting the ink.

8. The printing apparatus of claim 6, wherein the nozzle comprises a Laval nozzle.

9. The printing apparatus of claim 1, wherein the ink comprises at least one component in a solid state and/or at least one component in a liquid state.

10. The printing apparatus of claim 1, wherein the heating elements are positioned outside the ink treatment chamber.

11. A printing system comprising:

a first printing apparatus of claim 1, the ink of the first printing apparatus having a first color; and a second printing apparatus of claim 1, the ink of the second printing apparatus having a second color.

12. A printing apparatus comprising:

a housing defining an ink treatment chamber;

an inlet for receiving into the ink treatment chamber ink in a non-gaseous state;

heating elements for heating the ink received in the ink treatment chamber; and a nozzle for ejecting the heated ink, wherein heating the ink causes the ink to be changed to gas in the ink treatment chamber and wherein the nozzle ejects the ink in the gaseous state, wherein the ink in the non-gaseous state is received in a liquid state and wherein heating the ink causes evaporation of the ink, and wherein the nozzle comprises a Laval nozzle.

* * * * *